United States Patent [19]

Burrows

[11] Patent Number: 4,532,948

[45] Date of Patent: Aug. 6, 1985

[54] WALKER WITH A FLEXIBLE SEAT

[76] Inventor: Esther J. Burrows, 57-132B Piedmont Dr., Port Jefferson, N.Y. 11776

[21] Appl. No.: 581,728

[22] Filed: Feb. 21, 1984

[51] Int. Cl.[3] ..... A61H 3/00

[52] U.S. Cl. ..... 135/67; 297/6; 297/45; 297/441

[58] Field of Search ..... 135/67; 297/45, 441, 297/457, 6; D3/7, 8

[56] References Cited

U.S. PATENT DOCUMENTS

| | | | |
|---|---|---|---|
| 2,798,533 | 7/1957 | Frank | 135/67 X |
| 3,123,379 | 3/1964 | Stocking | 297/441 X |
| 3,993,349 | 11/1976 | Neufeld et al. | 297/6 |
| 4,118,065 | 10/1978 | Watkins | 297/45 |
| 4,298,016 | 11/1981 | Garelick | 135/67 |
| 4,345,790 | 8/1982 | Coe | 297/6 |
| 4,415,198 | 11/1983 | Brearley | 297/441 X |

*Primary Examiner*—Robert A. Hafer
*Assistant Examiner*—Arnold W. Kramer
*Attorney, Agent, or Firm*—Edith Grill

[57] ABSTRACT

A walker provided with a nonremovable flexible material seat of sufficient slack for comfortable sitting, suspended from a pair of upper level horizontal brace members on parallel opposite sides of the walker frame, by directly attaching a rectangular piece of strong flexible material onto said pair of oppositely positioned horizontal brace members.

15 Claims, 4 Drawing Figures

WALKER WITH A FLEXIBLE SEAT

BACKGROUND AND PRIOR ART

The present invention relates to a walker provided with a nonremovable flexible material seat, having sufficient slack for comfortable sitting, directly attached to, and suspended from a pair of horizontal side brace members on the parallel side frames of a folding or non-folding type walker. The foldability and/or crushability of this material seat permits it to be simply pushed forward out of the walking path of the invalid or other user.

The prior art is replete with a variety of walkers equipped with rigid and removable seats dating from 1923 as shown in U.S. Pat. No. 1,448,783, wherein is disclosed a wood or metal seat supported by straps hingedly connected to the front of a semi-circular reinforcing brace bar and suspended from the semi-circular handlebar of a walker by means of chains which raises the seat when not in use. U.S. Pat. No. 1,971,583 discloses another rigid seat bolted to the rear posts of a walker, which can be raised to one side of said walker to provide an entrance therein. U.S. Pat. No. 2,866,495 discloses a combined walker and chair wherein a rigid horizontal seat is disposed on a U-shaped horizontal brace assembly which remains horizontal when the seat is moved into a vertical position. U.S. Pat. No. 3,354,893 discloses a walker containing a rigid seating platform pivotally mounted to oppositely disposed arms of the U-shaped horizontal brace member which is held in vertical position by a spring member. U.S. Pat. No. 3,633,906 discloses a rigid seat panel or platform disposed on the arms of a U-shaped horizontal brace member by means of hooks on both the left and right sides and another pair of front hooks for hanging the seat in a vertical position when not in use. U.S. Pat. No. 4,162,101 discloses a walker and a rigid pivotal seat mounted on the front legs of a walker, which is spring loaded and capable of swinging upright and parallel to the right forward leg when not in use. U.S. Pat. No. 4,212,493 discloses a rigid seat pivotally mounted to one of the rear legs and engageable with the other rear leg closing the rear of the walker when in use. U.S. Pat. No. 4,345,790 discloses a walker with a rigid uphostered seat suspended from a pair of horizontal members on opposite sides of a walker frame by means of S-hooks, so that the seat can be completely removed or left hanging vertically from one side of the walker, when not in use. Canadian Pat. No. 1,093,949 discloses a walker and a rigid removable seat assembly mounted on the side frames at the rear of the walker. All of aforesaid rigid seats are either totally removable from the walker, and/or movable to one side of the walker in order to afford adequate space within its framework for the user to walk therein. An extra burden is placed on the user of these walkers to either pull down, pull up, or pull to the side, the seat for use; and again to remove the seat from the walking space when not needed. In addition, a rigid seat is not very comfortable.

Likewise, rigid fabric seats disposed on walkers are also disclosed in the prior art as shown in U.S. Pat. No. 2,798,533, wherein a fabric is sewed onto a rigid U-shaped swinging frame hingedly attached to the front legs of the walker and supported on pins projecting from the rear legs of the walker. This rigid frame onto which the fabric is sewed provides rigidity to the seat.

British Pat. No. 1,103,142 discloses a removable seat for a walker comprising a foldable sheet of fabric or plastic attached to the vertical members of the side frames of the walker by means of several clamping means on each of the four corners of said sheet. The fabric seat is preferably reinforced by two diagonally crossed strips of fabric sewn onto the bottom surface of the hemmed rectangular fabric sheet, which provides rigidity to the fabric seat.

Non-rigid fabric seats suspended within a walker have also been known in the prior art as early as 1920, as shown in U.S. Pat. No. 1,361,102 wherein is described a rolling crutch having a unitary deep seat and back suspended therein, and supported from the vertical front legs and the horizontal side braces by means of hooks or the like. U.S. Pat. No. 2,224,246 discloses a removable seat affixed to a walker in the form of a sheet of canvas attached at one end to a front horizontal connecting bar of the walker frame, and at the other end, to a removable roller which rests on the horizontal side brace bars of the walker, when in use. When the seat is not in use, the fabric is furled on the removable bar which is disconnected from the pair of side brace bars and the seat remains suspended from the front connecting bar. U.S. Pat. No. 3,993,349 discloses an invalid support device useful as a walker which includes an elongated sling of canvas pivotally secured to a pair of T-shaped bars by means of a pair of long hooks, capable of functioning both as a seat when the hooks are vertical, or as a backrest when the hooks are horizontal.

However, none of the above cited art discloses a walker provided with a nonremovable comfortable flexible material seat having about 2 to 3 inches slack, suspended from, and directly attached to the oppositely positioned upper level horizontal side brace members of a walker, by means of permanently stitching said flexible material onto said side brace members.

SUMMARY OF THE INVENTION

It has now been found that the addition of the nonremovable flexible material seat directly to the upper level horizontal side brace members of a walker in accordance with present invention, eliminates the disadvantages of the prior art seats which are complex in structure, heavy, cumbersome and cannot be attached to folding walkers.

The advantages of the present nonremovable flexible material seat and its mode of attachment to the walker is readily apparent. It is very simple to use by even the most severly handicapped as well as the novice. It is geared for the use of any age group where a walker is necessary or desirable. The individual simply turns around from the walking position and sits down. The crushable nature of the flexible material enables the user to simply push it forward out of the way in order to resume walking. There is no need to lower a seat for sitting, and then raise the seat to remove it from the path of walking. There is no mechanism in this present seat attachment that can malfunction, whereas the prior art removable seats are subject to malfunction. The slack provided by the present flexible seat enables the user to sit comfortably and safely without fear of sliding off, as with a rigid seat. Present flexible material seat can readily be fitted to any existing walker having oppositely disposed parallel high level horizontal side brace members, including folding walkers. The nature of the flexible material seat permits concomitant folding of the material when the walker is folded. The flexible nature of the seat also permits its use over a toilet seat, with the walker positioned over the toilet seat and the flexible seat simply pushed out of the way by the user. This walker can also be used to facilitate walking on sand, or other soft surfaces.

Accordingly, it is a primary object of this invention to provide a walker with a flexible material seat having sufficient slack for comfortable sitting.

Another object of this invention is to provide a nonremovable flexible material seat directly fitted to the oppositely positioned high level horizontal side brace members of a walker.

Another object of this invention is to provide a nonremovable flexible material seat capable of being fitted to a folding, or non-folding walker, without interfering with the folding mechanism.

Another object of this invention is to provide a walker with a nonremovable seat by sewing a single flexible sheet of material onto the horizontal side brace members of a walker.

Still another object of this invention is to provide a nonremovable flexible material seat comprising a single rectangular sheet of flexible material folded over the oppositely positioned horizontal side brace members of the walker and attaching said sheet to said brace members by means of stitching the folded material either down the middle, or at both ends thereof, to enclose said brace members.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the present invention, as embodied and broadly described herein, the novel walker of present invention is provided with a nonremovable flexible seat directly attached to, and suspended from, a pair of upper level horizontal side brace members of a walker comprising a pair of parallel side frames connected by at least one front horizontal bar; each side frame including a front and rear vertical leg connected at their upper ends by a top horizontal connecting member provided with a hand grip, and at least one upper level horizontal brace member between said front and rear leg.

More specifically, the seat comprises a single rectangular sheet of flexible material folded over and secured to the oppositely positioned upper level horizontal side brace members by means of sewing stitches to enclose said side brace members. The stitches may be either down the middle of said seat or at both ends of the seat. The sheet of flexible material used as the seat may be any durable strong, lightweight fabric or a strong, flexible plastic or flexible lightweight leather. The tensile strength of the seat material must be sufficient to support the weight of the invalid or other user of the walker. A preferred material is canvas which is lightweight, durable, strong, washable, and may be in all colors or in attractive decorative designs for the enjoyment of the user of the walker. Fabrics such as linen and cotton are not suitable.

More specifically, present invention relates to a nonremovable flexible material seat adapted to be permanently suspended within a walker frame to provide a seat of sufficient slack for comfortable sitting for the user thereof, while resting between walking periods, which can be simply pushed out of the walking path after resting, comprising a single rectangular sheet of sturdy flexible material folded over and secured to the oppositely positioned upper level horizontal side brace members of the side frames of the walker by means of sewing stitches.

DETAILED DESCRIPTION OF THE INVENTION

Figure 1:
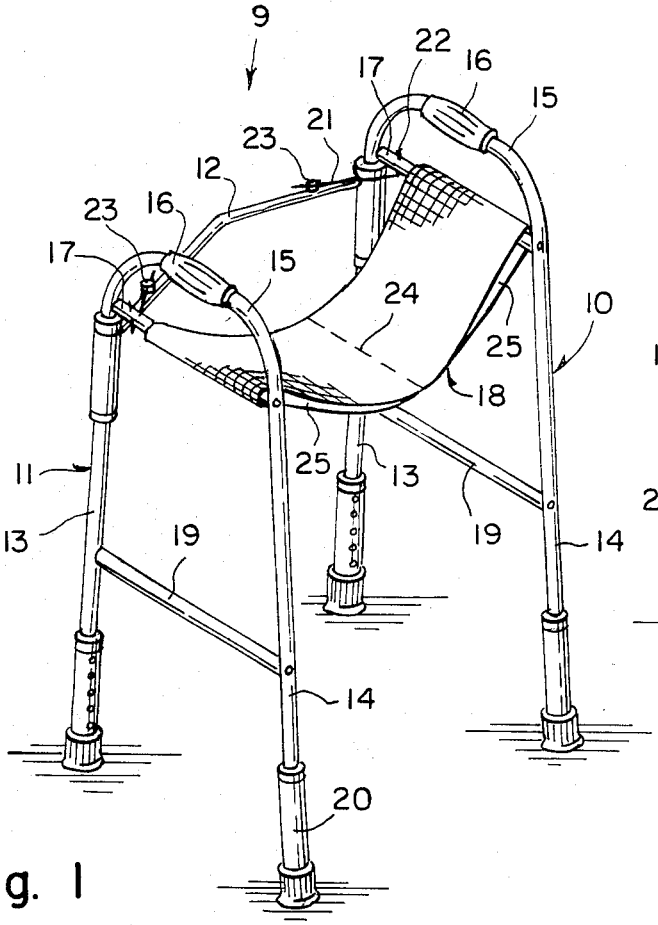
FIG. 1 is a perspective view of a walker with attached seat, according to present invention.
Figure 2:
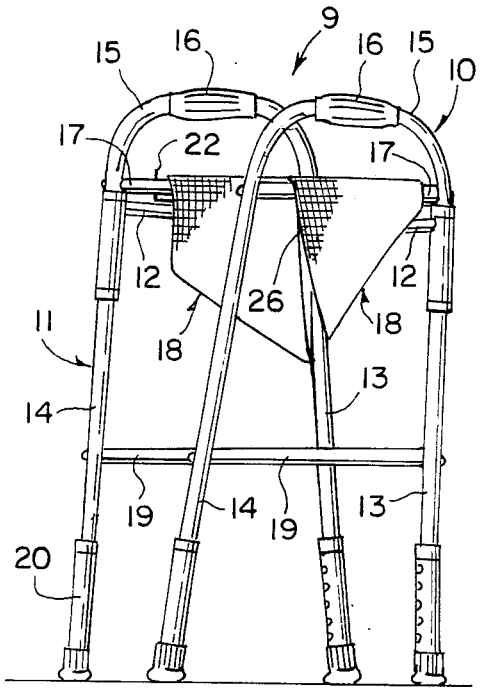
FIG. 2 is a perspective view of a folded walker with attached seat, according to present invention.

FIGS. 1 and 2 represent a typical walker 9 comprising a pair of parallel right and left side frames 10 and 11 respectively, of similar construction, connected by at least one front horizontal connecting member 12 which may be straight or slightly curved as shown. Each side frame includes a front and rear vertical leg, 13 and 14 respectively, connected at their upper ends by a top horizontal connecting member 15 provided with a handgrip 16. Each side frame is an inverted U-shaped frame, delineating front leg 13 and rear leg 14 connected by horizontal member 15, which may be of unitary construction. Each side frame is additionally provided with an upper level horizontal brace member 17 between front leg 13 and rear leg 14, onto which flexible material seat 18 is secured. A lower level brace member 19 may optionally be secured between front leg 13 and rear leg 14 of each side frame 10 and 11 to provide additional strength and rigidity to walker 9. The lower portions of each vertical leg can be telescopically adjusted, as at 20, to adjust the height of the walker.

In a folding walker, the front legs 13 of right side frame 10 and left side frame 11 are connected to front connecting member 12 by means of hinges or other suitable connecting means, which permit the side frames 10 and 11 to be folded into overlapping positions as shown in FIG. 2, against front connecting member 12. Levers 21 or other suitable connecting means are pivotally connected to upper brace members 17, as at 22, on each side frame, and engage locking mechanisms 23 on front connecting member 12. Flexible seat 18 is folded along line 26 as shown in FIG. 2.

Figure 3:
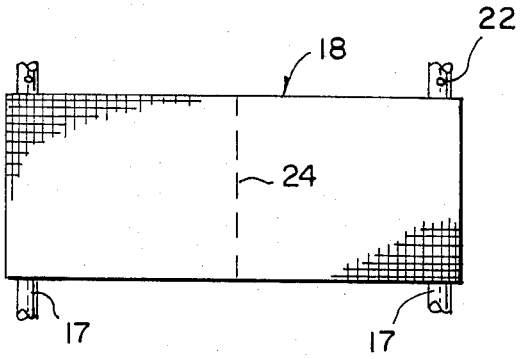
FIG. 3 is a top view of the seat secured to the walker, according to present invention.
Figure 4:
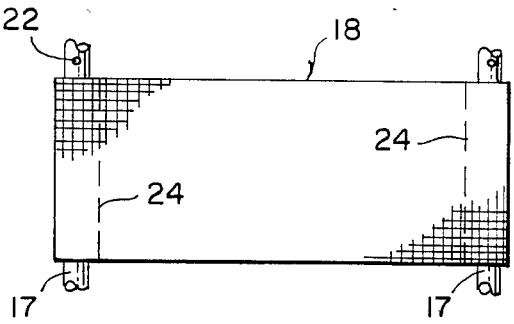
FIG. 4 is a top view of an alternative means of securing the nonremovable flexible seat to the walker, according to present invention.

The seat 18 comprises a rectangular sheet of flexible material suspended from, and permanently secured to side brace members 17 by means of sewing stitches 24 which enclose side brace members 17, as shown by FIGS. 3 and 4. This seat can be constructed by folding a single rectangular sheet of material of double the length of the seat over both side brace members 17, and stitching both free, narrow ends to the folded material, down the middle of the seat as shown in FIG. 3. Another method utilizes a single rectangular sheet of material of the length of the seat folded over both side brace members 17, and stitching each free narrow end to the folded material at each end of the seat as shown in FIG. 4. The dimensions of the seat is generally about 21 to 25 inches long by 7 to 9 inches wide. The length of the seat must afford sufficient slack for comfortable sitting, such as 2 to 4 inches, as shown in FIG. 1. This slack is not deep enough to make it difficult to get up or sit down, and eliminates the difficulties encountered with a rigid or taut seat which makes it difficult to sit down and remain seated. Accordingly, the length of the rectangular seat is about 2 to 4 inches greater than the space between said side frames, 10 and 11. The width of the seat is slightly less, about 1 to 2 inches, than the length of side brace members 17 in order to afford space for the seat to be pushed forward so as not to impede walking and provide ample walking space within the walker. However, the crushability and/or the foldability of the material minimizes this requirement.

The seat of FIG. 3 wherein the stitching is down the middle of the seat forms two openings 25 which extends from the front to the rear of the seat. These openings can be used as open ended pockets for carrying simple objects such as newspapers and the like, without impeding walking. One can also close one end of these open pockets, if desired.

This flexible material seat which is comfortable, safe and simple to use can be readily retrofitted to existing walkers, both folding or non-folding. The seat of present invention needs no adjustment or repair after its installation and is not subject to deterioration or breakage. One very big advantage is the washability (for fabrics) or cleanability (plastic or leather) of present material seat. The simplicity of present novel flexible seat makes it readily available at minimal cost.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. A seat for a walker comprising a substantially rectangular sheet of flexible material having fastening means on the narrow ends thereof for slidably fastening the seat to the opposite horizontal braces of a walker, to suspend the seat in a slack manner, whereby the seat can be used to support a seated person, and due to its slidable fastening means and the flexibility of the slack material, the seat can be readily pushed forward by the body of the user to not interfere with the usual walking attitude of the user.

2. The seat according to claim 1, wherein the seat comprises a single rectangular sheet of flexible material folded over and secured to said oppositely positioned horizontal brace members by means of sewing stitches to enclose said brace members.

3. The seat according to claim 2, wherein the folded sheet of material of the seat is stitched down the middle of the seat.

4. The seat according to claim 3, wherein the flexible seat comprises two pockets, at least one pocket being closed at one end.

5. The seat according to claim 3, wherein the flexible seat comprises two open ended pockets.

6. The seat according to claim 2, wherein the folded sheet of material of the seat is stitched at both ends of the seat.

7. The seat according to claim 2, wherein the seat comprises a single flexible sheet of canvas material.

8. A walker provided with a flexible material seat slidably attached to, and suspended from the oppositely positioned upper level horizontal side braces of a walker, said seat comprising a substantially rectangular sheet of flexible material having fastening means on the narrow ends thereof for slidably fastening to the opposite horizontal braces of a walker, to suspend the seat in a slack manner, whereby the seat can be used to support a seated person, and due to its slidable fastening means and the flexibility of the slack material, the seat can be readily pushed forward by the body of the user to not interfere with the usual walking attitude of the user.

9. A walker according to claim 8, wherein the walker comprises a pair of parallel side frames connected by at least one front horizontal bar; each side frame including a front and rear vertical leg connected at their upper ends by a top horizontal connecting member provided with a hand grip, and at least one upper level horizontal brace member between said front and rear leg, to which said seat is slidably attached.

10. The walker according to claim 9, which is a folding type walker, wherein the side frames are folded into overlapping positions against front connecting member of the walker frame.

11. The walker according to claim 9, wherein the length of the rectangular seat is about 2 to 3 inches greater than the space between said side frames, in order to provide sufficient slack for comfortable sitting.

12. The walker according to claim 9, wherein the width of the rectangular seat is slightly less than the length of said horizontal side braces in order to afford space for the seat to be pushed forward and provide ample walking space within the walker.

13. The walker according to claim 9, wherein the length of the rectangular seat is about 2 to 3 inches greater than the space between said side frames, and the width is about 1 to 2 inches less than the length of said horizontal side brace members.

14. The walker according to claim 9, which is a non-folding walker.

15. The walker according to claim 9, wherein the lower portions of each vertical leg can be telescopically adjusted to adjust the height of the walker.

* * * * *